US007766268B2

(12) United States Patent
Ting

(10) Patent No.: US 7,766,268 B2
(45) Date of Patent: Aug. 3, 2010

(54) SHREDDER BLADE SET WITH LOW RESISTANCE

(75) Inventor: Allen Ting, SanChung (TW)

(73) Assignee: Michilin Prosperity Co., Ltd., SanChung, Taipei Hsien (TW)

( * ) Notice: Subject to any disclaimer, the term of this patent is extended or adjusted under 35 U.S.C. 154(b) by 0 days.

(21) Appl. No.: 11/797,680

(22) Filed: May 7, 2007

(65) Prior Publication Data

US 2008/0128538 A1 Jun. 5, 2008

(30) Foreign Application Priority Data

Dec. 4, 2006 (TW) ..... 95221313 U

(51) Int. Cl.
*B02C 18/16* (2006.01)

(52) U.S. Cl. ..... 241/236; 241/295

(58) Field of Classification Search ..... 241/236, 241/295

See application file for complete search history.

(56) References Cited

U.S. PATENT DOCUMENTS 4,869,435 A * 9/1989 Pistorius et al. ..... 241/100

* cited by examiner

*Primary Examiner*—Mark Rosenbaum
(74) *Attorney, Agent, or Firm*—Bacon & Thomas, PLLC

(57) ABSTRACT

A shredder blade set with low resistance combines pressed blades and polished blades in various ways to form a shredder blade set. The shredder blade set has an appropriate friction for solving the problems with tilted or wrinkled paper due to insufficient friction or power waste due to large friction.

3 Claims, 2 Drawing Sheets

SHREDDER BLADE SET WITH LOW RESISTANCE

BACKGROUND OF THE INVENTION

1. Field of Invention

The invention relates to a shredder and, in particular, to a shredder with a shredding blade set with different combinations of pressed blades and polished blades. It provides an appropriate friction for solving the problems with tilted or wrinkled paper due to insufficient friction or power waste due to large friction.

2. Related Art

As shown in FIGS. 1 and 2, the outer parts of shredder cutting blades are often polished or pressed, respectively. During the shredding process, the former in FIG. 1 has a smaller friction. Therefore, paper is likely to be tilted or wrinkled. To solve this problem, the winding angle of the polished cutting blades of FIG. 1 has to be increased in order to increase the friction. Nonetheless, the power of the motor has to increase correspondingly. This not only increases the costs for motor components, the power consumption rises as well. For the pressed cutting blades as shown in FIG. 2, the friction thereof is too large during the shredding process. Thus, even though it solves the problem with tilted or wrinkled paper, it still needs a powerful motor to provide a sufficiently strong driving force. The problem with high power consumption still exists.

SUMMARY OF THE INVENTION

An objective of the invention is to provide a shredder blade set with a smaller friction without the need to increase the motor power. With different combinations of blades, an appropriate friction is achieved so that the problems with tilted or wrinkled paper and high power consumption are simultaneously solved.

To achieve the above objective, one blade axis is mounted with pressed blades. Another blade axis is mounted with polished blades. The two blade axes are combined to form the blade set of a shredder. Alternatively, pressed blades and polished blades can be alternately mounted on one blade axis. Another blade axis is mounted with the preset and polished blades in the same way. The pressed and polished blades on one blade matches with the corresponding ones of the other blade axis, thereby forming the shredder blade set. Yet another solution is to pressed blades and polished blades can be alternately mounted on one blade axis. Another blade axis is mounted with pressed blades and polished blades in the order opposite to the former blade axis. They are combined such that the pressed and polished blades on one blade axis match with the polished and pressed blades on the other blade axis, respectively. The problems with tilted or wrinkled paper and high power consumption can be simultaneously solved by providing an appropriate friction in the shredder blade set.

BRIEF DESCRIPTION OF THE DRAWINGS

The invention will become more fully understood from the detailed description given herein below illustration only, and thus is not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
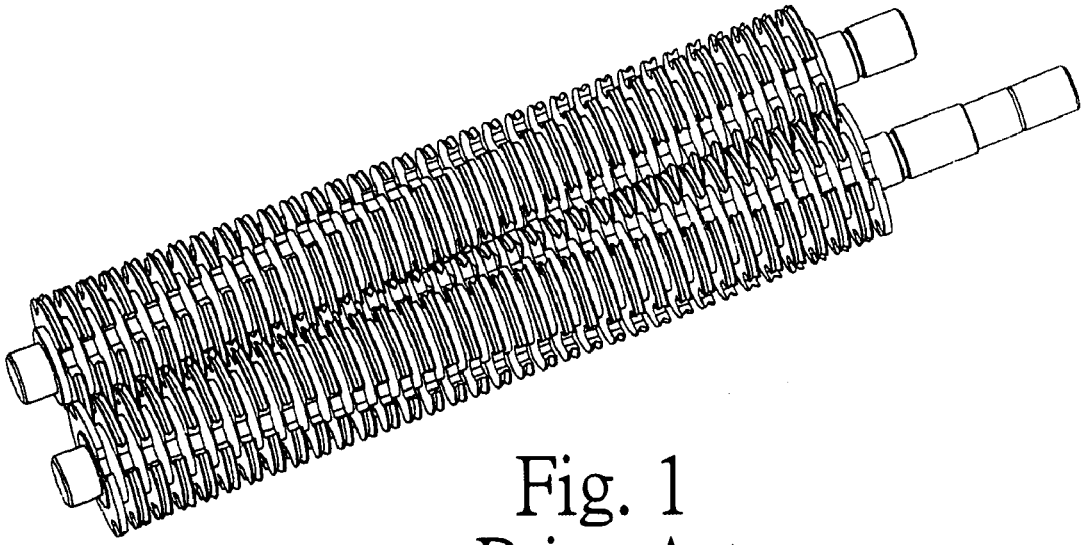
Fig. 1 Prior Art
FIG. 1 is a three-dimensional view of the shredder blade set composed of polished blades in conventional shredders.
Figure 2:
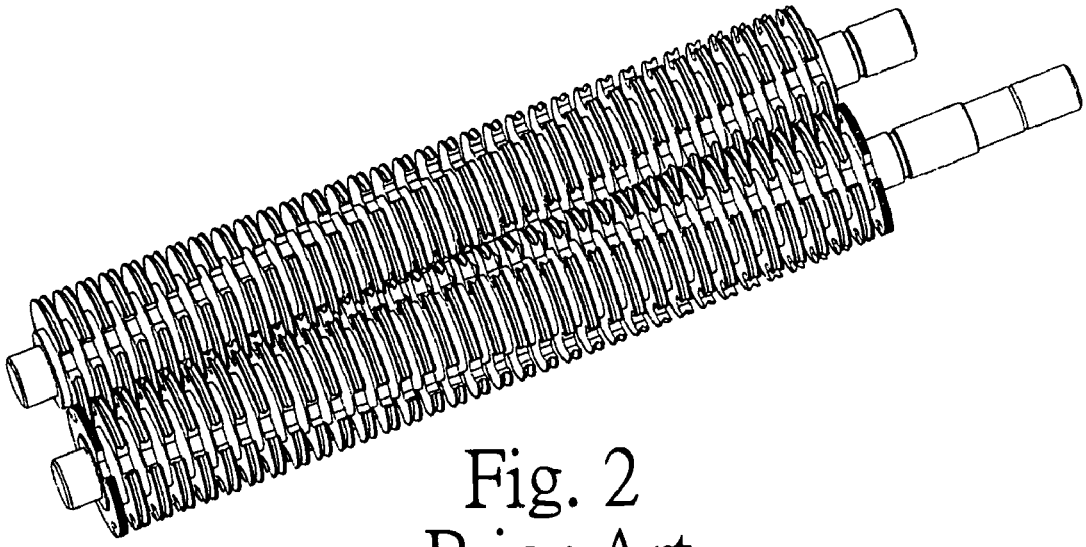
Fig. 2 Prior Art
FIG. 2 is a three-dimensional view of the shredder blade set composed of pressed blades in conventional shredders.
Figure 3:
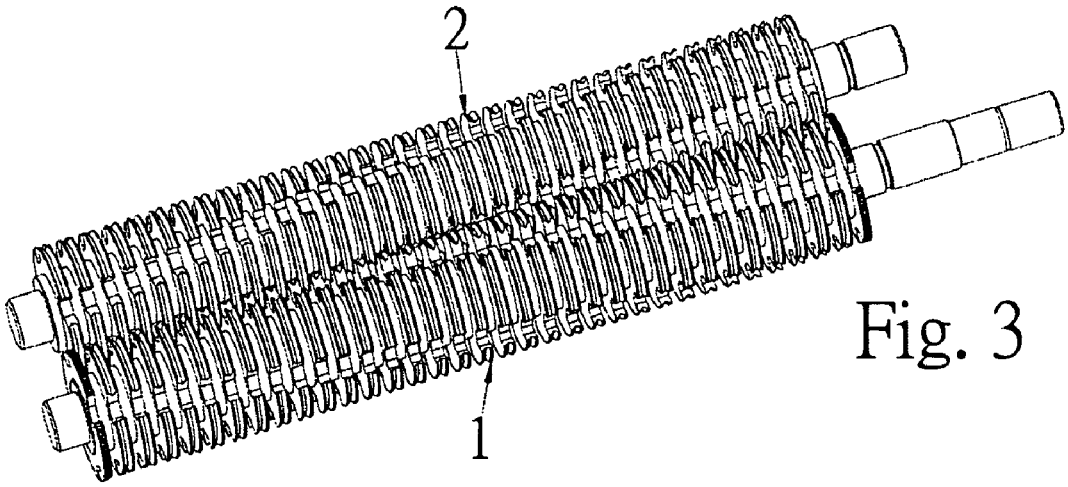
FIG. 3 is a three-dimensional view of the first embodiment of the invention.

With reference to FIG. 3, one blade axis is mounted with several pressed cutting blades 1 and the other blade axis is mounted with the same number of polished cutting blades 2 correspondingly. The two blade axes are combined to form a shredder blade set with an appropriate friction. This configuration solves the problems with tilted or wrinkled paper and high power consumption.

Figure 4:
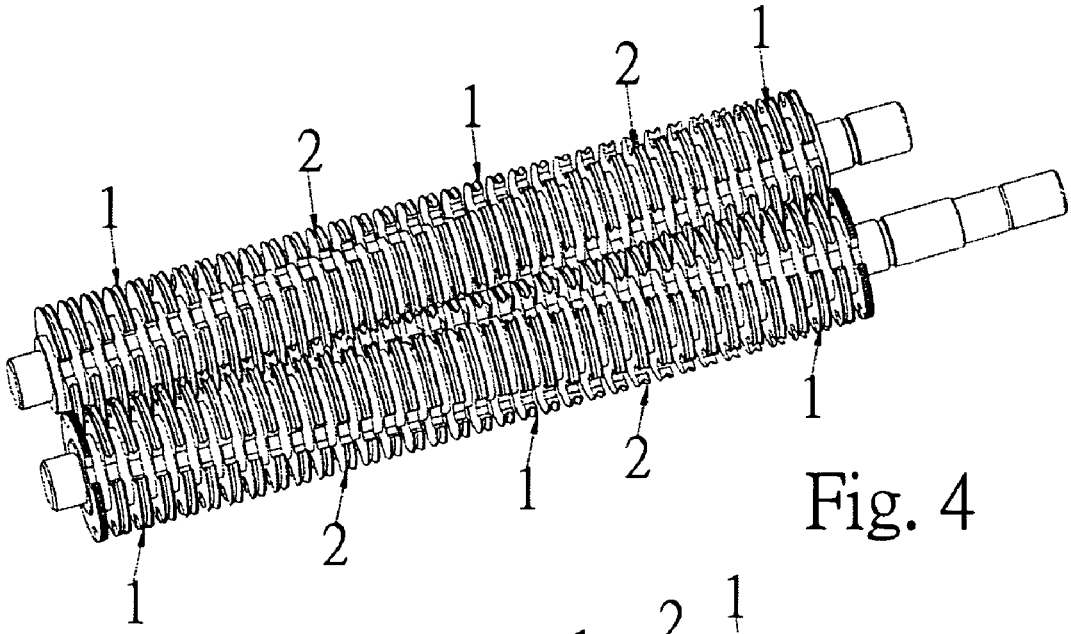
FIG. 4 is a three-dimensional view of the second embodiment of the invention.

With reference to FIG. 4, in another embodiment of the invention, one blade axis is mounted alternately with several pressed blades 1 and several polished blades 2. Another blade axis is mounted with the same pattern of pressed blades 1 and polished blades 2 They are combined in such a way that the pressed blades 1 and the polished blades 2 on one blade axis match with the pressed blades 1 and the polished blades 2 on the other blade axis, respectively, forming a shredder blade set. Likewise, this second configuration solves the problems with tilted or wrinkled paper and high power consumption.

Figure 5:
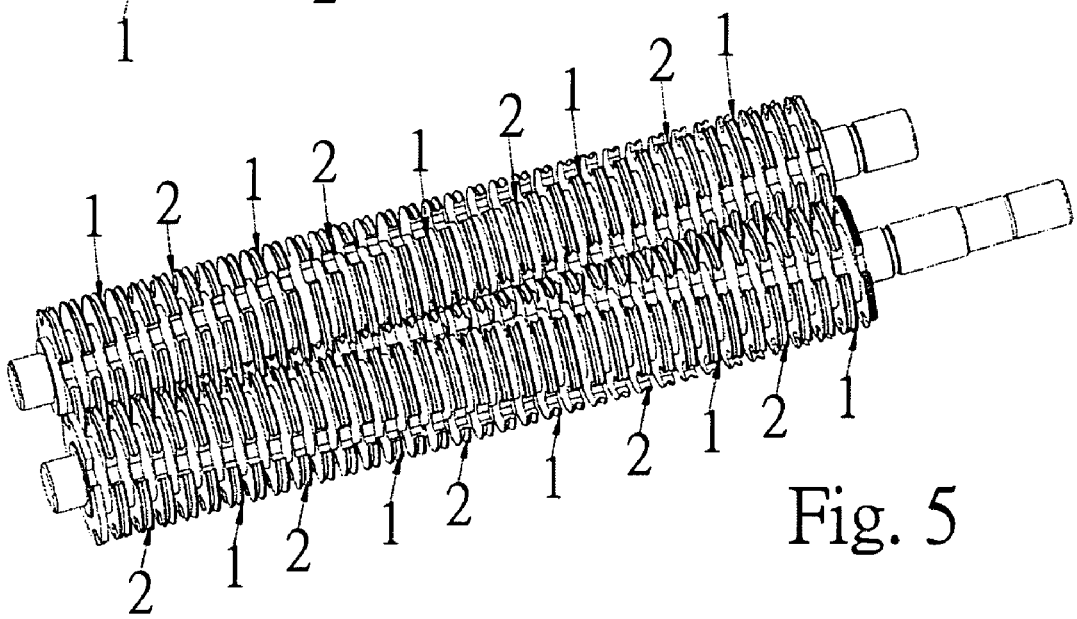
FIG. 5 is a three-dimensional view of the third embodiment of the invention.

The third embodiment of the invention is shown in FIG. 5. One blade axis is mounted alternately with pressed blades 1 and polished blades 2. Another blade axis is also mounted alternately with pressed blades 1 and polished blades 2, but in the opposite order to the former blade axis. They are combined in such a way that the pressed blades 1 and the polished blades 2 on one blade axis match with the polished blades 2 and the pressed blades 1 on the other blade axis, respectively, forming a shredder blade set. This third configuration also solves the problems with tilted or wrinkled paper and high power consumption.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A shredder blade set with a small friction, comprising a first blade axis mounted with pressed cutting blades and a second blade axis mounted with polished cutting blades, wherein the two blade axes are combined to form the shredder blade set and the pressed cutting blades have a higher friction than the polished cutting blades such that a friction of said shredder blade set is determined by a combination of the higher friction of said pressed blades and the lower friction of said polished blades.

2. A shredder blade set with a small friction, comprising a first blade axis mounted alternately with pressed cutting blades and polished cutting blades and a second blade axis mounted alternately with pressed cutting blades and polished cutting blades in the same order as the first blade axis, wherein the pressed cutting blades and polished cutting blades on the first blade set match with the pressed blades and polished blades on the second blade set, respectively, and the pressed cutting blades have a higher friction than the polished cutting blades such that a friction of said shredder blade set is determined by a combination of the higher friction of said pressed blades and the lower friction of said polished blades.

3. A shredder blade set with a small friction, comprising a first blade axis mounted alternately with pressed cutting blades and polished cutting blades and a second blade axis mounted alternately with pressed cutting blades and polished cutting blades in the opposite order as the first blade axis, wherein the pressed cutting blades and polished cutting blades on the first blade set match with the pressed cutting blades and polished cutting blades on the second blade set, respectively, and the pressed cutting blades have a higher friction than the polished cutting blades such that a friction of said shredder blade set is determined by a combination of the higher friction of said pressed blades and the lower friction of said polished blades.

* * * * *